US008424984B2

(12) United States Patent
Ritter

(10) Patent No.: US 8,424,984 B2
(45) Date of Patent: Apr. 23, 2013

(54) APPARATUS FOR RELEASABLY COUPLING A DRAWER TO A DRAWER PULL-OUT GUIDE

(75) Inventor: Thomas Ritter, Lustenau (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 12/956,045

(22) Filed: Nov. 30, 2010

(65) Prior Publication Data

US 2011/0068670 A1 Mar. 24, 2011

Related U.S. Application Data

(63) Continuation of application No. PCT/AT2009/000143, filed on Apr. 9, 2009.

(30) Foreign Application Priority Data

Jun. 10, 2008 (AT) ..... A 934/2008

(51) Int. Cl.
*A47B 95/00* (2006.01)
*A47B 88/00* (2006.01)

(52) U.S. Cl.
USPC ..... 312/333; 312/334.5; 292/DIG. 56

(58) Field of Classification Search ..... 312/333, 312/334.1, 330.1, 334.4–334.8, 334.14, 334.44, 312/334.46; 384/21, 22; 292/1, DIG. 56, 292/DIG. 73; 403/329, DIG. 14
See application file for complete search history.

(56) References Cited

U.S. PATENT DOCUMENTS

| | | | | | |
|---|---|---|---|---|---|
| 1,963,220 | A | * | 6/1934 | Anderson | 312/334.11 |
| 3,074,750 | A | * | 1/1963 | Craig et al. | 292/336.3 |
| 4,073,519 | A | * | 2/1978 | Kurozu et al. | 292/216 |
| 4,274,689 | A | * | 6/1981 | Vander Ley et al. | 312/333 |
| 4,275,940 | A | * | 6/1981 | Draper | 312/209 |
| 4,465,324 | A | * | 8/1984 | Rock et al. | 384/19 |
| 4,756,564 | A | * | 7/1988 | Ikeda | 292/216 |
| 5,255,983 | A | * | 10/1993 | Parvin | 384/21 |
| 5,261,737 | A | * | 11/1993 | Faust et al. | 312/334.46 |
| 5,281,021 | A | * | 1/1994 | Rock et al. | 312/334.32 |

(Continued)

FOREIGN PATENT DOCUMENTS

| | | |
|---|---|---|
| DE | 93 14 893 | 2/1994 |
| DE | 94 09 899 | 7/1995 |

(Continued)

OTHER PUBLICATIONS

Certified Translation of DE 20 2007 006 549 U1.*

(Continued)

*Primary Examiner* — David Dunn
*Assistant Examiner* — Ryan A Doyle
(74) *Attorney, Agent, or Firm* — Wenderoth, Lind & Ponack, L.L.P.

(57) ABSTRACT

An apparatus is provided for releasably coupling a drawer to a rail, which can be pulled out in a longitudinal direction, of a drawer pull-out guide. The apparatus has a holding part which interacts with a mating holding part in the coupled state in order to establish the releasable connection. At least that region of the holding part which comes into contact with the mating holding part is made flexible, preferably by attaching a flexible piece of material, so that any longitudinal play of the drawer which may occur in relation to the rail can be compensated.

15 Claims, 7 Drawing Sheets

U.S. PATENT DOCUMENTS

| | | | | |
|---|---|---|---|---|
| 5,292,198 | A * | 3/1994 | Rock et al. | 384/21 |
| 5,302,016 | A * | 4/1994 | Lautenschlager et al. | 312/333 |
| 5,542,759 | A * | 8/1996 | Krivec | 312/334.44 |
| 5,580,139 | A * | 12/1996 | Grabher | 312/333 |
| 5,588,729 | A * | 12/1996 | Berger | 312/334.4 |
| 5,632,541 | A * | 5/1997 | Uthoff | 312/333 |
| 6,036,291 | A * | 3/2000 | Rock | 312/333 |
| 6,119,317 | A * | 9/2000 | Pfister | 24/514 |
| 6,454,371 | B1 * | 9/2002 | Muterthies et al. | 312/263 |
| 6,685,288 | B1 * | 2/2004 | MacMillan | 312/334.46 |
| 7,905,525 | B2 * | 3/2011 | Badia | 292/262 |
| 2002/0158557 | A1 * | 10/2002 | Weichelt | 312/334.4 |
| 2004/0095047 | A1 * | 5/2004 | Salice | 312/332.1 |
| 2004/0227440 | A1 * | 11/2004 | Booker et al. | 312/334.1 |
| 2004/0239219 | A1 * | 12/2004 | Kim et al. | 312/334.4 |
| 2005/0108857 | A1 * | 5/2005 | Wartian et al. | 24/10 R |
| 2005/0231083 | A1 * | 10/2005 | Garcie, Jr. | 312/333 |
| 2008/0159670 | A1 * | 7/2008 | Huang et al. | 384/18 |
| 2008/0218045 | A1 * | 9/2008 | Moser | 312/333 |
| 2008/0247812 | A1 * | 10/2008 | Embacher | 403/231 |
| 2008/0303397 | A1 * | 12/2008 | Chen et al. | 312/334.46 |
| 2009/0066207 | A1 * | 3/2009 | Laible | 312/404 |
| 2009/0195131 | A1 * | 8/2009 | Chi et al. | 312/319.1 |
| 2009/0261700 | A1 * | 10/2009 | Chen et al. | 312/334.46 |
| 2010/0156121 | A1 * | 6/2010 | Badia | 292/216 |

FOREIGN PATENT DOCUMENTS

| | | | |
|---|---|---|---|
| DE | 20 2007 006 549 | | 7/2007 |
| DE | 20 2007 001 782 | | 1/2008 |
| DE | 20 2007 011 868 | | 1/2009 |
| EP | 0 041 616 | | 12/1981 |
| EP | 0 421 458 | | 4/1991 |
| WO | WO 2006034820 | A1 * | 4/2006 |

OTHER PUBLICATIONS

International Search Report issued Aug. 4, 2009 in International (PCT) Application No. PCT/AT2009/00143.

Austrian Patent Office Search Report completed Jan. 16, 2009 in Austrian Patent Application No. A 934/2008.

* cited by examiner

APPARATUS FOR RELEASABLY COUPLING A DRAWER TO A DRAWER PULL-OUT GUIDE

This application is a Continuation of International application No. PCT/AT2009/000143, filed Apr. 9, 2009, the entire disclosure of which is incorporated herein by reference.

BACKGROUND OF THE INVENTION

The present invention concerns an apparatus for releasably coupling a drawer to a rail, which can be pulled out in a longitudinal direction, of a drawer pull-out guide. The apparatus comprises a holding portion which in the coupled condition co-operates with a counterpart holding portion to produce the releasable connection.

The invention further concerns a drawer having an apparatus according to the invention for releasably coupling a drawer to a rail of a pull-out guide.

In accordance with the state of the art, coupling apparatuses are known, by which a drawer can be fitted or removed in its entirety to or from a rail of a drawer pull-out guide so that the drawer—for example, for cleaning purposes—can be completely released from the drawer pull-out guide and can then be re-secured thereto. In that case the drawer pull-out guide is pre-mounted to the article of furniture, whereupon in the mounting procedure the drawer to be fastened is pushed on to the pull-out guide until automatic latching of the drawer to the pull-out rail which is in the closed position takes place. Examples of such a securing arrangement are shown in EP 0 421 458 B1 and in DE 20 2007 006 549 U1 to the present applicant. In that case, latching is effected by latching portions, the displaced abutment surfaces of which are latched in successive relationship in an opening in the rail and thereby, when the drawer is pushed in, provide for gradual latching with a steady reduction in the clearance between the drawer and the pull-out guide. In general, it is desirable for the drawer in the coupled condition to be connected fixedly and substantially play-free to the rail of the pull-out guide so that upon actuation of the drawer in normal use there is no relative movement with respect to the rail. Such a relative movement would have a troublesome effect on operating comfort and convenience of the drawer.

Coupling apparatuses having a resilient latching hook or a latching pawl for releasably coupling a drawer to a rail of a drawer pull-out guide are known for example from DE 94 09 899 U1 and DE 93 14 893 U1.

SUMMARY OF THE INVENTION

It is therefore an object of the present invention to propose an apparatus of the general kind set forth in the opening part of this specification, by which the drawer can be substantially play-free connected to the rail of the pull-out guide.

In an advantageous configuration in accordance with the invention, the object is achieved in that at least that region of the holding portion, that comes into contact with the counterpart holding portion, is of a yielding nature, preferably by the mounting of a yielding material portion so that a longitudinal play which possibly occurs of the drawer in relation to the rail can be compensated.

The present invention is therefore based on the basic idea that a resiliently yielding region is operative between the regions of the holding portion and the counterpart holding portion—which implement the releasable connection between the drawer and the rail. The resiliently yielding region acts virtually as a cushion between the holding portion and the counterpart holding portion. The arrangement of such a cushion means that it is possible to effectively compensate for tolerances between the drawer and the rail. Thus, any longitudinal play which possibly occurs in respect of the drawer in relation to the rail can be compensated whereby the drawer can be play-free connected to the rail of the pull-out guide.

The resiliently yielding region can be associated either with the holding portion or the counterpart holding portion. A one-piece configuration of the yielding region with the holding portion and/or the counterpart holding portion is also conceivable. In that respect, a structurally simple configuration provides that to give the cushioning effect there can be a separate yielding portion comprising an elastically yielding plastic material (preferably rubber-elastic material).

In a preferred embodiment of the invention it can be provided that the holding portion is associated with a coupling apparatus to be secured to the drawer, and the counterpart holding portion is associated with the rail. In that respect, it may be desirable if in the mounted position the coupling apparatus is arranged at the underside of a drawer bottom and laterally at the front end of the drawer bottom. In that case, in the course of the mounting operation, the drawer can be pushed on to the rail of the drawer pull-out guide until an abutment associated with the rail limits the displacement travel of the drawer. The abutment is disposed in a per se known manner at the rear end of the rail. The abutment has a pin which can pass into an opening provided in the drawer rear wall. The abutment arranged on the rear end of the rail therefore fixes the drawer at its rear end while the front end of the rail can be coupled by way of the provided coupling apparatus to the front end of the rail. It can desirably be provided that the holding portion has at least one abutment which in the coupled condition of the apparatus is in contact by way of the yielding material portion with the front end of the rail or an edge of the rail. An embodiment of the invention can provide that the abutment is arranged at the bottom of a receiving slot of the coupling apparatus or the rail. The receiving slot permits, in particular, laterally stable holding of the coupling apparatus (and therewith the drawer) in relation to the rail. In a preferred embodiment of the invention, it can be provided that in the coupled condition of the drawer to the rail the yielding material portion is arranged between the abutment of the coupling apparatus and the front end, preferably the front face, of the rail.

For fitting and removing the drawer without using a tool, the coupling apparatus can have at least one springy latching portion or at least one latching portion which can be acted upon by a spring and which is latchable into preferably an opening in the rail of the drawer pull-out guide. In this connection, it may be desirable if the latching portion has at least one and preferably a plurality of abutment surfaces which can be brought into contact with an edge of the opening. In that respect, it may be desirable if the abutment surfaces are arranged in mutually displaced relationship in the pull-out direction of the drawer. The abutment surfaces which are displaced in the pull-out direction of the drawer permit sequential latching engagement of the latching portion on the rail, whereby the play between the drawer and the pull-out guide can also be reduced.

In a particular embodiment of the invention, it can be provided that the latching portion is movable by a release portion so that the coupled condition of the latching apparatus is releasable. To release the coupling it may be possible for the release portion to be formed by a pivotal lever or a bendable lever. Such coupling apparatuses with a latching portion are already known in many configurations in the state of the art and therefore do not need to be described in greater detail at this point.

It should be noted that the holding portion can be associated with the drawer pull-out guide and the counterpart holding portion can be associated with the drawer. The drawer according to the invention is characterised in that it has an apparatus of the described kind.

BRIEF DESCRIPTION OF THE DRAWINGS

Further details and advantages of the present invention will be described with reference to the specific description hereinafter. In the drawings.

DETAILED DESCRIPTION OF THE INVENTION

Figure 1:
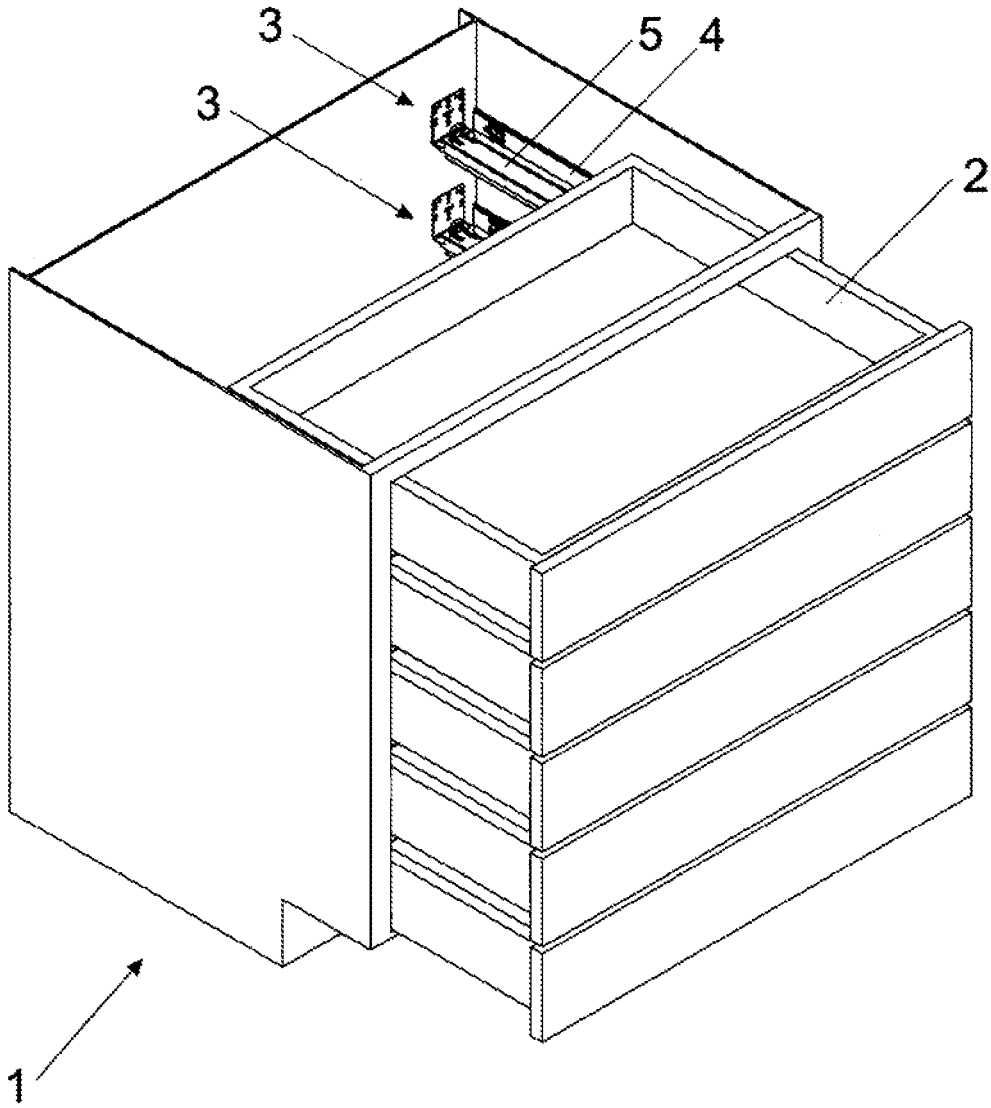
FIG. 1 is a perspective view of an article of furniture with drawers which can be fitted to and removed from a drawer pull-out guide, in their entirety.

FIG. 1 is a perspective view of an article of furniture 1 having a plurality of drawers 2 which are arranged displaceably relative to the furniture carcass by way of drawer pull-out guides 3. The drawer pull-out guide 3 includes a carcass rail 4 to be secured to the furniture carcass and at least one rail 5 which is displaceable relative to the carcass rail and which can be connected to the drawer 2 by way of a coupling apparatus that is still to be described. Two drawer pull-out guides 3 are respectively associated with each drawer 2 and are pre-fitted at mutually opposite side walls of the furniture carcass. The drawers 2 can be mounted to and removed from the movable rails 5 without using a tool so that the drawers 2 are completely removable from the pull-out guides 3.

Figure 2:
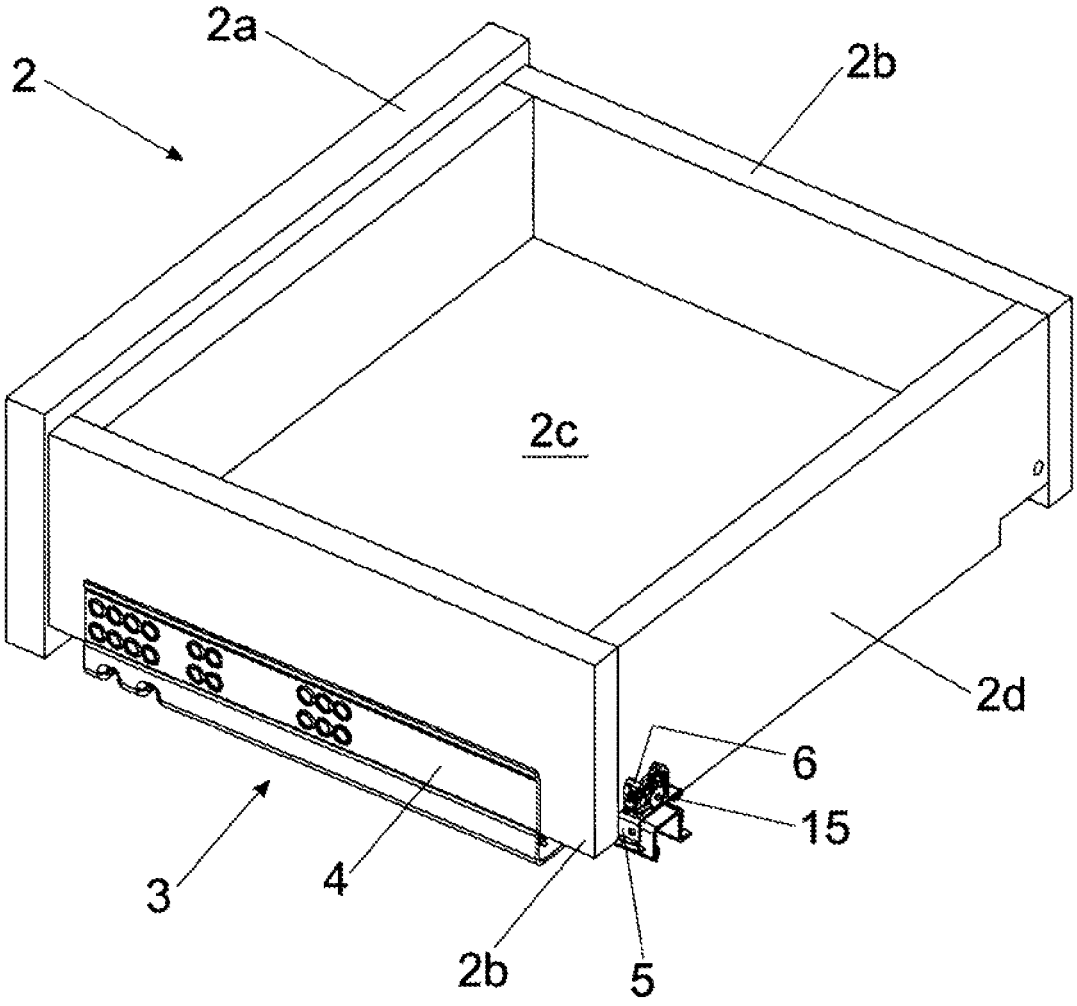
FIG. 2 is a perspective view of a drawer secured to the drawer pull-out guide.

FIG. 2 is a perspective view of a drawer 2 coupled to the drawer pull-out guide 3. The drawer 2 includes a front panel 2*a*, side walls 2*b*, a drawer bottom 2*c* and a drawer rear wall 2*d*. It is possible to see the stationary carcass rail 4 and the rail 5 which is displaceable relative thereto. Arranged at the rear end of the rail 5 which can be pulled out is an abutment having a pin 6—which is preferably adjustable in height—and which in the mounted condition of the drawer 2 is disposed in an opening provided for same in the drawer rear wall 2*d*. The pin 6 can be adjusted in respect of height by the adjusting wheel 15 so that in that way the inclination of the drawer 2 relative to the rail 5 of the drawer pull-out guide 3 (and therewith the gap configuration) can be adjusted. When fitting the drawer 2 it is pushed on to the rail 5 which is in the closed position until the pin 6 passes into the provided opening in the drawer rear wall 2*d* and thus defines the rear end abutment. The front region of the drawer 2 is coupled to the front end of the rail 5 which can be pulled out, by way of the coupling apparatus that is still to be described.

Figure 3A:
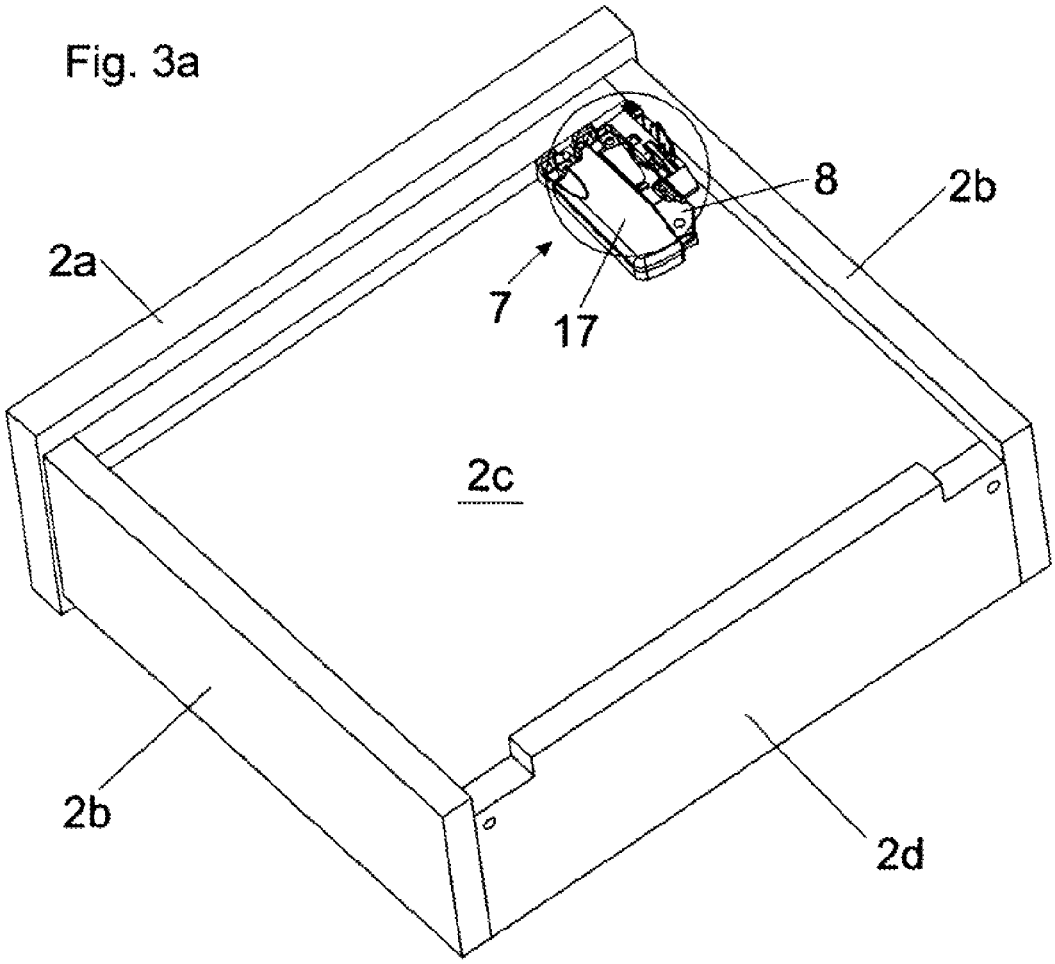
FIGS. 3*a*, 3*b* are views of the underside of the drawer and a detail view thereof on an enlarged scale.
Figure 3B:
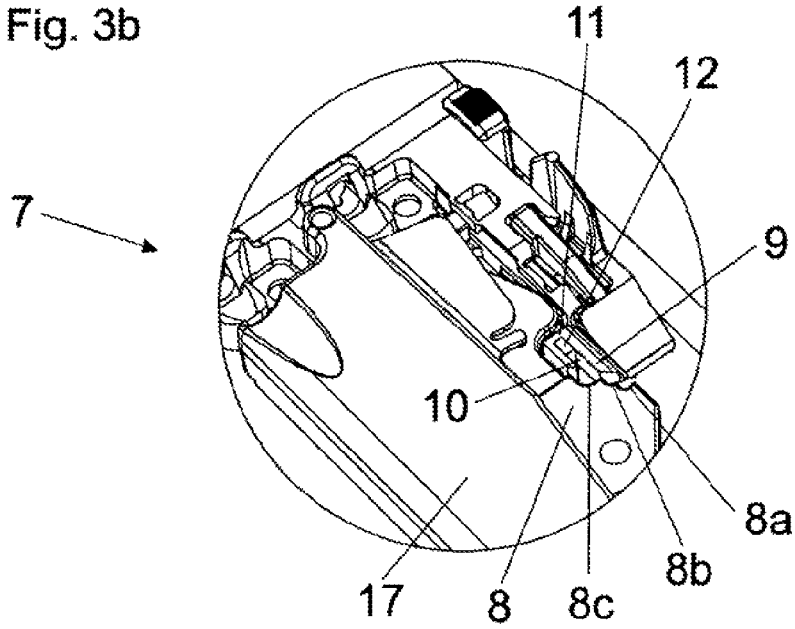

FIG. 3*a* is a view of the underside of the drawer 2. Mounted at the underside of the drawer bottom 2*c* in the immediate proximity of the front panel 2*a* is an apparatus 7 for releasably coupling the drawer 2 to the rail 5 (not shown here) of the drawer pull-out guide 3. The apparatus 7 includes a resilient or spring-loadable latching portion 8 which in the course of the mounting procedure can be automatically latched to the rail 5. To release the arresting action, there is provided a release portion 17 in the form of a pivotal lever which is to be operated manually so that the coupling between the apparatus 7 and the rail 5 can be released. FIG. 3*b* shows a view on an enlarged scale of the region circled in FIG. 3*a*. The apparatus 7 includes a U-shaped holding portion 9 having a receiving slot 10, at the bottom of which is arranged an abutment 11 for the rail 5. When mounting the drawer 2 therefore the front end of the movable rail 5 (which in the illustrated embodiment forms the counterpart holding portion) is introduced into the receiving slot 10 until the latching portion 8 can be automatically latched with its abutment surfaces 8*a*, 8*b*, 8*c* arranged in a stepped configuration, with an edge or abutment surface of the rail 5. In the mounted condition the abutment surfaces 8*a*, 8*b*, 8*c* extend transversely—preferably at a right angle—to the longitudinal extent of the rail 5. The abutment surfaces 8*a*, 8*b*, 8*c* which are displaced in the depth direction of the rail 5 permit gradual latching of the drawer 5 with a sequential reduction in the play between the drawer 2 and the rail 5. It will be appreciated that a latching portion 8 with only one abutment surface 8*a* is also possible. What is of relevance now is a resiliently yielding region 12 which in the illustrated embodiment is embodied by the arrangement of a yielding material portion of plastic. That region 12 is arranged in the illustrated Figure in the receiving slot 10 so that the non-yielding abutment 11—when the drawer 2 is in the mounted condition—is in contact by way of that resiliently yielding region 12 with the counterpart holding portion (not shown here) of the rail 5.

Figure 4A:
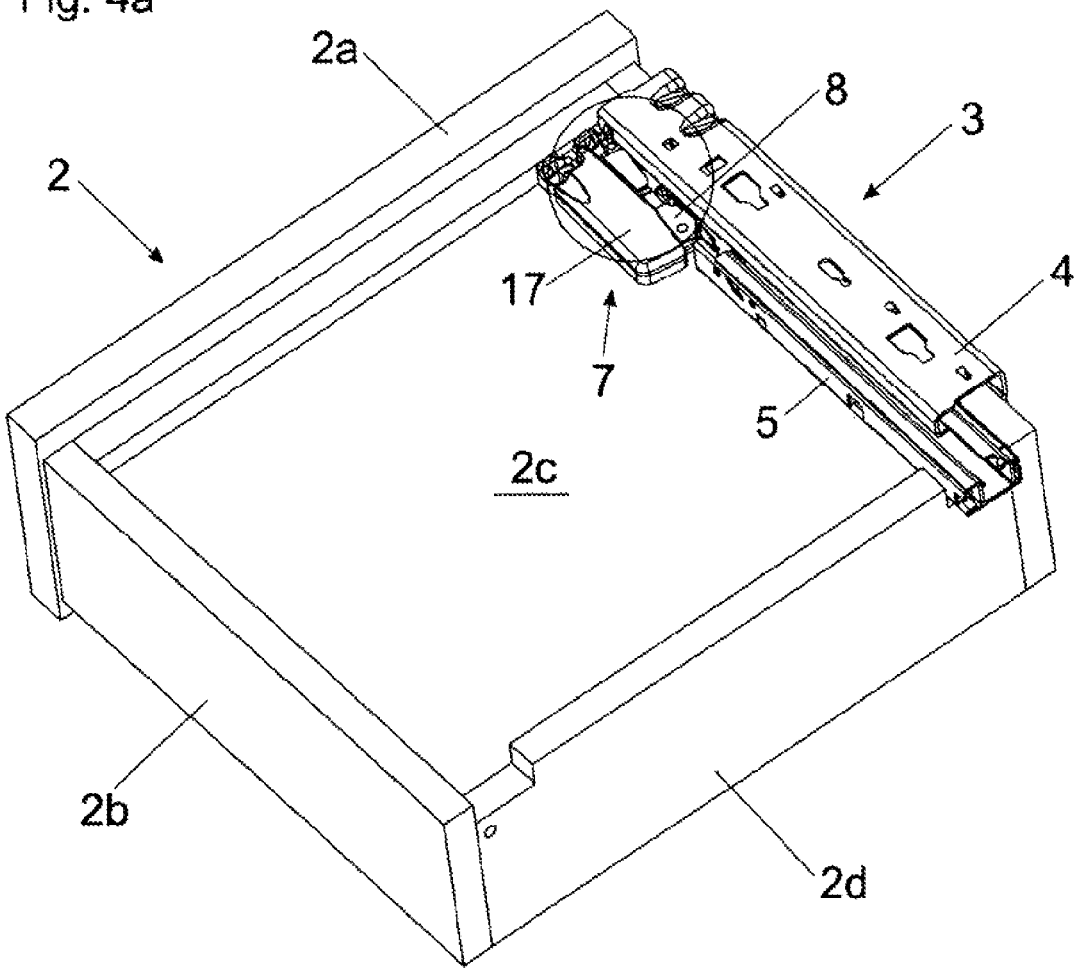
FIGS. 4*a*, 4*b* are views of the underside of the drawer in the mounted condition.

FIG. 4*a* is a view from below illustrating the mounting condition of the drawer 2 to the rail 5. It is possible to see the carcass rail 4 which is to be secured to the furniture carcass, with the rail 5 displaceable relative thereto. The apparatus 7 for releasably coupling the drawer 2 to the rail 5 is fixedly secured at the underside of the drawer bottom 2*c* in the immediate proximity of the front panel 2*a*. The latching portion 8 is anchored by way of one of the abutment surfaces 8*a*, 8*b*, 8*c* shown in FIG. 3*b* in an opening in the rail 5. To release the arresting action there is a release portion 17 which is in the form of a pivotal lever whereby the latching portion 8 is releasable relative to the rail 5.

Figure 4B:
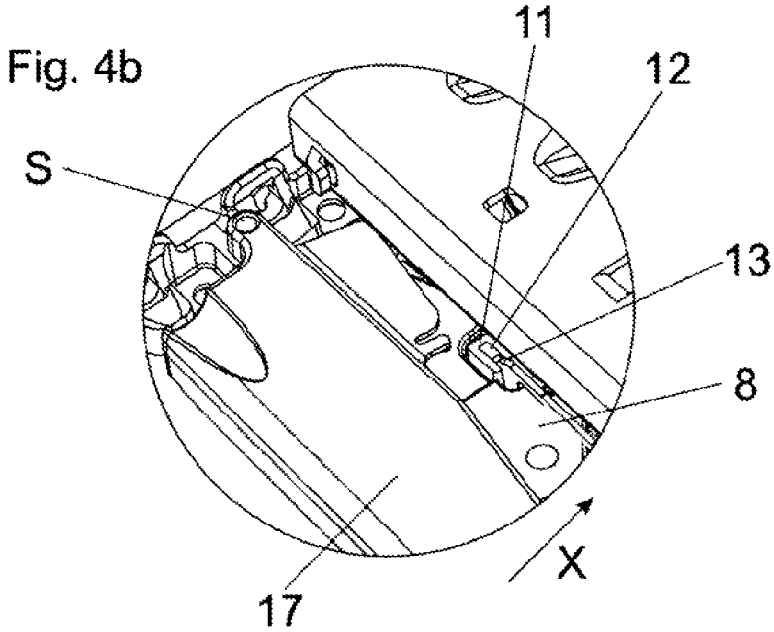

FIG. 4*b* shows the region circled in FIG. 4*a* on an enlarged scale. It shows the resiliently yielding region 12 arranged between the rigid abutment 11 of the apparatus 7 secured to the drawer bottom 2*c* and the rigid counterpart holding portion 13 of the rail 5. That yielding region 12 which is operative as a cushion between the abutment 11 and the counterpart holding portion 13 of the rail 5 makes it possible to compensate for length tolerances so that the drawer 2 can be connected in play-free relationship to the displaceable rail 5 of the drawer pull-out guide 3. To release the arresting action, the release portion 17 is pushed by hand about the pivot axis S in the direction of the illustrated arrow X whereupon the latching portion 8 is moved out of the opening in the rail 5 so that the drawer 2 can be removed completely from the drawer pull-out guide 3, for example for cleaning and servicing purposes.

Figure 5A:
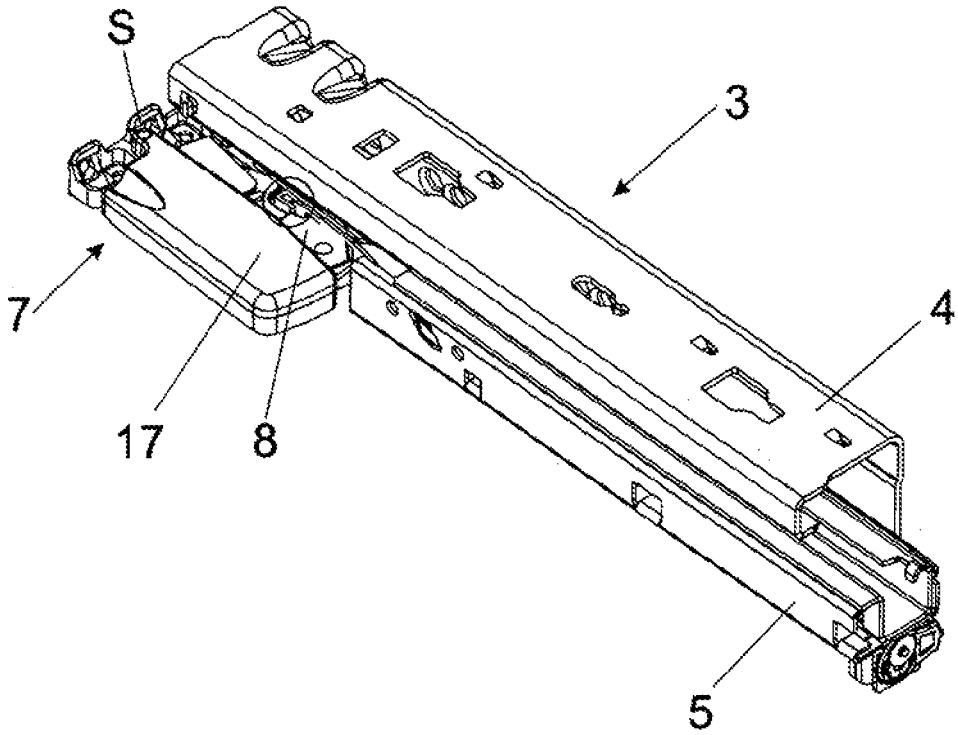
FIGS. 5*a*, 5*b* are views of the underside of the pull-out guide with the mounted coupling apparatus.
Figure 5B:
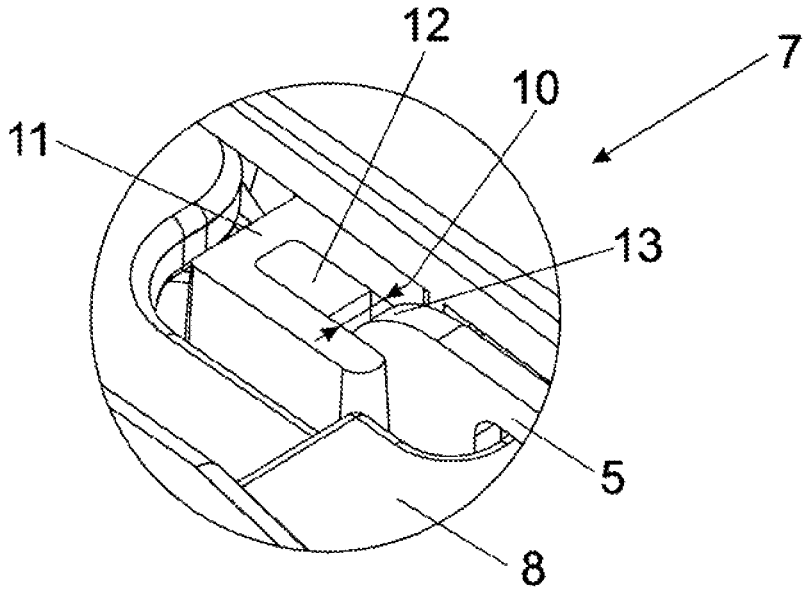

FIG. 5*a* also shows a view from below of the drawer pull-out guide 3 in the coupled condition with the apparatus 7. For the sake of clarity, the drawer 2 is not shown. It is possible to see the latching portion 8 which is latched to the extendable drawer 5, wherein the latching portion 8 can be released by actuation of the release portion 17. FIG. 5*b* shows a detail view on an enlarged scale of the coupled apparatus 7. It is possible to see the receiving slot 10 which receives the front end of the rail 5 which can be pulled out. The abutment 11 arranged at the bottom of the receiving slot 10 forms the holding portion which in the mounted condition is in contact with the counterpart holding portion 13 of the rail 5 by way of the yielding region 12. The resiliently yielding region 12 in the illustrated embodiment is in the form of a separate plastic portion comprising rubber-elastic material. It is equally possible for the resilient region 12 to be in one piece with the abutment 11 or also to be in the form of part of the counterpart holding portion 13 of the rail 5.

Figure 6A:
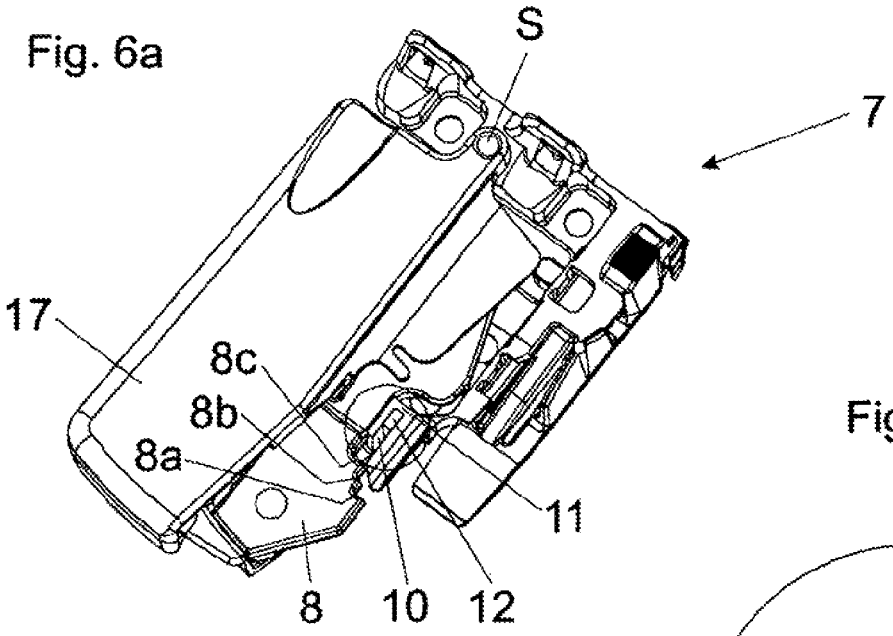
FIGS. 6*a*-6*d* are various views of the coupling apparatus.

FIG. 6*a* shows a perspective view from above of the apparatus 7 to be secured to the drawer bottom 2*c*. It is possible to see the movable latching portion 8 with its displaced abutment surfaces 8*a*, 8*b*, 8*c*. In the course of mounting the drawer 2 the front end of the rail 5 is introduced into the receiving slot 10 of the apparatus 7, where the yielding region 12 is also disposed for compensating for length tolerances which occur.

Figure 6B:
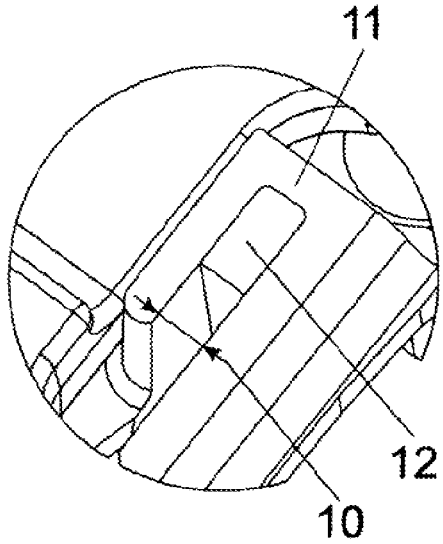
Figure 6C:
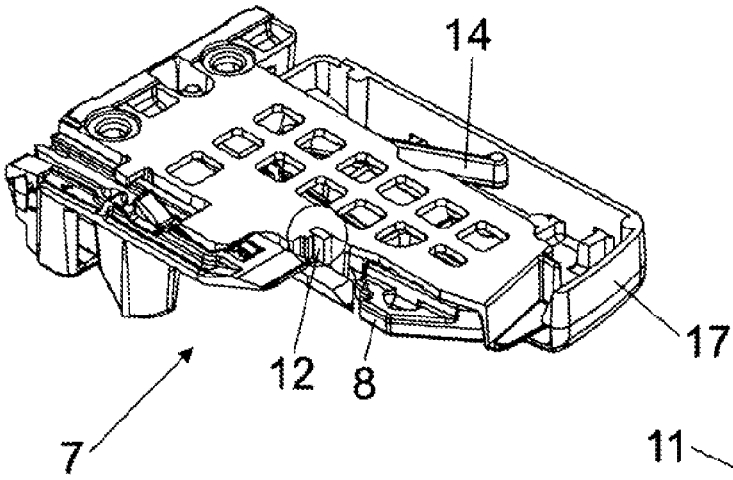
Figure 6D:
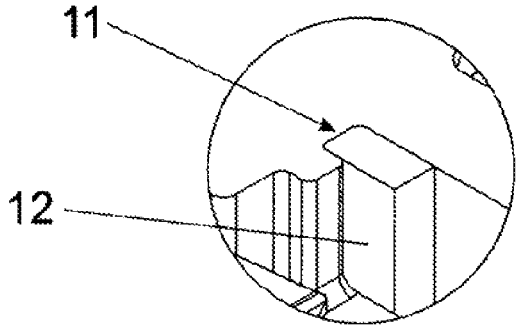

FIG. 6*b* shows a detail view on an enlarged scale of the apparatus 7. It is possible to clearly see the receiving slot 10 with the resiliently yielding region 12 for cushioning the abutment 11. FIG. 6*c* shows a perspective view of the apparatus 7 from below. The apparatus 7 is fixed with the flat side illustrated to the underside of the drawer bottom 2*c*. It is possible to see a resilient portion 14 for acting on the latching portion 8. FIG. 6*d* shows a detail view on an enlarged scale of the region circled in FIG. 6*c*, with the rigid abutment 11 which is cushioned by the rubber-elastic material of the resilient region 12.

Figure 7A:
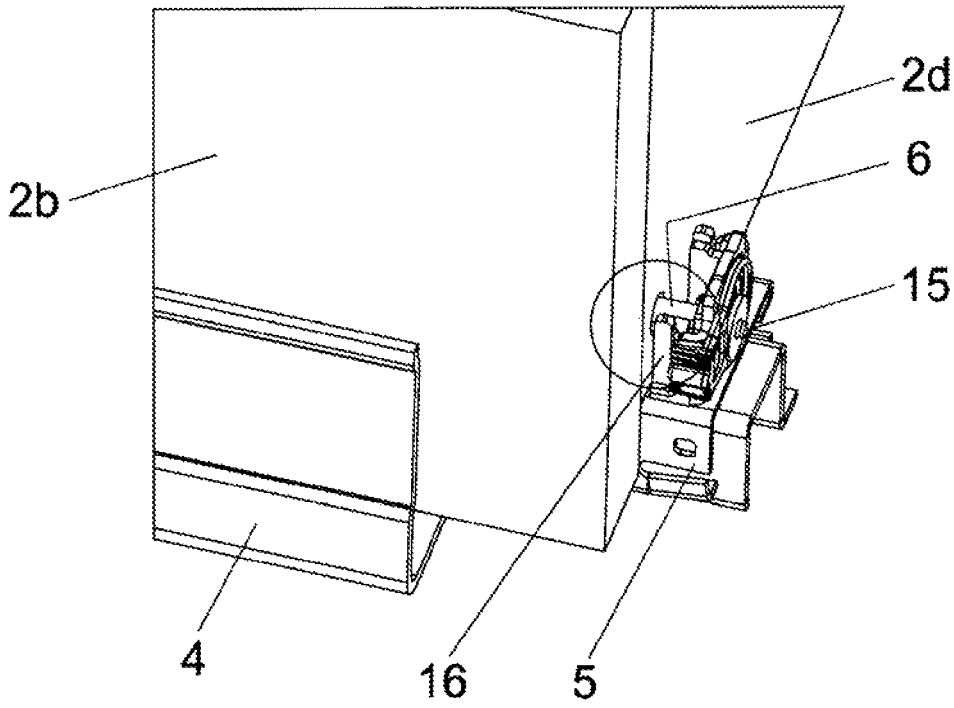
FIGS. 7*a*, 7*b* are perspective views of the rear side of the drawer in the mounted condition on the drawer pull-out guide.
Figure 7B:
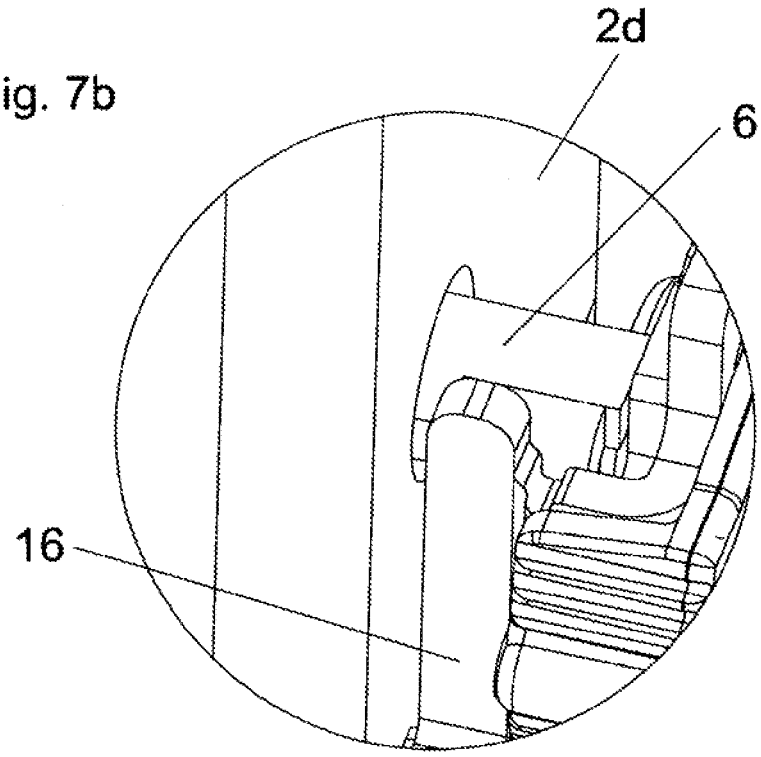

FIG. 7*a* shows a view of the drawer 2 in the region of the drawer rear wall 2*d*. The rear fixing of the drawer 2 relative to the rail 5 is effected by way of a horizontally oriented pin 6 which in the mounted condition is received in an opening in the drawer rear wall 2*d*. It is possible to see a rear abutment 16 against which the drawer rear wall 2*d* bears. The rear rigid abutment 16 limits the displacement travel of the drawer 2 in the depth direction of the article of furniture 1. The pin 6 is adjustable in height by the adjusting wheel 15 so that the inclination of the drawer 2 is adjustable. FIG. 7*b* shows a view on an enlarged scale of the region circled in FIG. 7*a*.

The present invention is not limited to the illustrated embodiment but includes or extends to all technical equivalents which can fall within the scope of the claims appended hereto. The positional references adopted in the description such as for example up, down, lateral and so forth are also related to the directly described and illustrated Figure and are to be appropriately transferred to the new position upon a change in position.

The invention claimed is:

1. An apparatus for enabling a drawer to be pulled out in a longitudinal direction, said apparatus comprising:

a drawer pull-out guide including a rail and a holding portion, said rail having a front end, and said holding portion of said drawer pull-out guide being arranged at said front end of said rail; and a coupling apparatus for releasably coupling the drawer to said rail, said coupling apparatus including a holding portion, said holding portion of said coupling apparatus including a region formed by a yielding material portion, and said yielding material portion being configured to engage said holding portion of said drawer pull-out guide arranged at said front end of said rail so as to produce a releasable connection, a latching portion configured to releasably couple the drawer with said rail of said drawer pull-out guide, and a release portion movable relative to said latching portion so that said latching portion is capable of being released from said rail of said drawer pull-out guide, wherein said yielding material portion is configured to yield so that longitudinal play of the drawer in relation to said rail is compensated, wherein said yielding material portion abuts said holding portion of said drawer pull-out guide, when said rail is coupled to the drawer, wherein said latching portion is latchable with an edge or with an abutment surface of said drawer pull-out guide, and said edge or said abutment surface for engagement with the latching portion is spaced from said front end of said rail and from said yielding material portion; and wherein said yielding portion has a first side, a second side, a third side and a fourth side, and when viewed from below, said holding portion of said coupling apparatus completely covers said first and second sides, partially covers said third side, and completely exposes said fourth side.

2. The apparatus according to claim 1, wherein said holding portion has at least one abutment which, when said rail is coupled to the drawer, is in contact via said yielding material portion with said front end of said rail or an edge of said rail.

3. The apparatus according to claim 2, wherein said abutment is arranged at a bottom of a receiving slot of said coupling apparatus.

4. The apparatus according to claim 1, wherein said latching portion is springy or is configured to be acted upon by a spring, and is latchable with said rail of said drawer pull-out guide.

5. The apparatus according to claim 4, wherein said latching portion is latchable into an opening of said rail of said drawer pull-out guide.

6. The apparatus according to claim 1, wherein said latching portion has at least one abutment surface configured and arranged so as to be capable of bearing against an edge of an opening of said rail.

7. The apparatus according to claim 6, wherein said latching portion has a plurality of abutment surfaces arranged in a mutually displaced relationship in a pull-out direction of the drawer.

8. The apparatus according to claim 1, wherein said release portion is a pivotal lever or a bendable lever.

9. The apparatus according to claim 1, wherein, in the mounted position, said apparatus is configured to be arranged at an underside of a bottom of the drawer and laterally at the front end of the bottom of the drawer.

10. The apparatus according to claim 1, wherein said region of said holding portion of said coupling apparatus and a region of said holding portion of said drawer pull-out guide are arranged transversely to a longitudinal direction of said rail.

11. The apparatus according to claim 1, wherein said yielding material portion is formed from an elastically yielding plastic material.

12. The apparatus according to claim 1, wherein said yielding material portion is a rubber-elastic material.

13. A drawer having an apparatus according to claim 1.

14. The apparatus according to claim 1, wherein said yielding material portion is an elastically yielding plastic material and is configured and arranged to operate as a cushion between said holding portion of said drawer pull-out guide and said coupling apparatus.

15. The apparatus according to claim 1, wherein the fourth side of the yielding portion is arranged so as to engage said holding portion of said drawer pull-out guide, said fourth side being arranged so as to be opposite said second side.

* * * * *